United States Patent [19]

Kubota

[11] 4,371,402

[45] Feb. 1, 1983

[54] PROCESS FOR PREPARATION OF FRUCTOSE-CONTAINING SOLID SUGAR

[75] Inventor: Hiroshi Kubota, Tokyo, Japan

[73] Assignee: Kawazu Sangyo Kabushiki, Kaisha, Japan

[21] Appl. No.: 290,198

[22] Filed: Aug. 5, 1981

[30] Foreign Application Priority Data

Aug. 11, 1980 [JP] Japan ..... 55-109264

[51] Int. Cl.[3] ..... C13F 1/02; C13F 1/04; C13K 11/00

[52] U.S. Cl. ..... 127/60; 127/61; 127/62; 210/634

[58] Field of Search ..... 127/60, 59, 58, 30, 127/62, 61, 15, 18; 210/634, 642

[56] References Cited

U.S. PATENT DOCUMENTS

| | | | |
|---|---|---|---|
| 2,357,838 | 9/1944 | Mahoney | 127/58 |
| 3,314,882 | 4/1967 | Schroeder | 210/642 |
| 3,816,175 | 6/1974 | Melaja | 127/60 |
| 4,162,926 | 7/1979 | Veltman et al. | 127/62 |
| 4,199,374 | 4/1980 | Dwivedi et al. | 127/60 |

FOREIGN PATENT DOCUMENTS

| | | | |
|---|---|---|---|
| 2015591 | 1/1972 | Fed. Rep. of Germany | 127/60 |
| 50-70536 | 6/1975 | Japan | 127/58 |
| 407947 | 4/1974 | U.S.S.R. | 127/60 |

*Primary Examiner*—Kenneth M. Schor
*Attorney, Agent, or Firm*—Pearne, Gordon, Sessions, McCoy & Granger

[57] ABSTRACT

This invention is directed to a process for obtaining fructose-containing solid sugar from fructose-containing liquid sugar by the steps of dehydration, aging and solidification. In the step of dehydration, fructose-containing liquid sugar is brought in the presence of an organic solvent exhibiting azeotropic behavior with respect to water, in contact with a stream of gas causing no denaturation of fructose-containing sugar to remove moisture contained therein. The fructose-containing liquid sugar obtained from said step of dehydration is subject to seed crystal addition treatment in the following step of aging. Lastly, the aged fructose-containing sugar obtained from said step of aging is introduced into anhydrous alcohol for solidification.

15 Claims, No Drawings

PROCESS FOR PREPARATION OF FRUCTOSE-CONTAINING SOLID SUGAR

BACKGROUND OF THE INVENTION

The present invention relates to a process for preparation of fructose-containing solid sugar and particularly to a technique for dehydration and solidification of fructose-containing liquid sugar. It should be realized that, in this specification, the term "solidification" includes both crystallization and formation of amorphous powder.

Fructose is obtained by hydrolysis (inversion) of sucrose or isomerization of glucose so far as it is on an industrial scale. In these cases, fructose-containing liquid sugar of two types primarily obtained are referred to as invert sugar and isomerized sugar. Assumed that said FE (Fructose Equivalent) is defined as $$FE = \frac{\text{fructose (g)}}{\text{fructose (g)} + \text{glucose (g)}} \times 100,$$

the invert sugar will have a FE of substantially 50 and the isomerized sugar will have a FE of substantially 40. Although said invert sugar or isomerized sugar is commercially available under such state, as a recent trend, these are available also in the form of secondary product obtained by a separation treatment through use of ion-exchange resin or inorgnic adsorbent so that the FE is increased substantially to 90, in view of a high value added of fructose.

Said fructose-containing sugar is liquid of which the moisture content is 10 to 20% by weight and has been directly used as food sweetener in practice mainly due to a difficulty for isolation of fructose from the fructose-containing liquid sugar as well as a difficulty for crystallization of fructose which is, in turn, due to a particular nature thereof. Fructose takes different molecular structures depending on whether it is crystal or solution in which fructose is present. Namely, it takes $\beta$-pyranose structure in crystal while it takes $\alpha$-pyranose structure together with a noticeable quantity of furanose structure and normal chain molecules, although the equilibrium of these structures or molecules of different types has not still been theoretically backed up. One of the most important physical properties of fructose is its solubility to water substantially higher than values exhibited by the other natural sugars and specifically as high as 96 W/V%. This means that fructose has a high affinity to water. However, decomposition temperature of fructose lies at a relatively low level between 102° C. and 104° C. and therefore is easily denatured by heating, so that it is impossible to remove water contained therein simply by heating. This makes it further difficult to solidify fructose. Effective solidification, i.e., crystallization or formation of amorphous powder of fructose having such characteristics requires a technical consideration higher than for the other sugars and, in fact, various techniques have already been attempted. Although there have been commercially available pure fructose crystal obtained by crystallizing the liquid fructose isolated as precisely as to FE value from 98 to 100 mainly as medical use, the well known process for pure fructose crystallization has various disadvantages. Namely, in the process of well known art, a quantity of alcohol at least same as and at most twice the quantity of moisture containing liquid fructose has been added to and dissolved in the latter, then subjected to seed crystal addition treatment for aging and thereafter to solid/liquid separation. According to this process of prior art, a filtrate obtained consists of hydrate alcohol and fructose dissolved in this alcohol and therefore the recovery of said alcohol as well as treatment of residual moisture containing fructose after said alcohol recovery are left to be done. It can not be expected to achieve crystal separation by directly recrystallization of said residual moisture containing fructose and a possible yield will be extremely low, so that a dehydration is required simultaneously with a purification by ion-exchange resin. Such process of prior art has been disadvantageous in a high loss of alcohol, fructose yield for every operation as low as 40 to 70% by weight, and in a batch or semi-batch operation. These inconveniences have prevented a production from being performed at an industrial or commercial scale.

Although a process for preparation of pure crystal fructose has been described above as the process of prior art, a technique for solidification of fructose-containing liquid sugar in the order of FE 40 to 90 has recently been interested more and more for a wide prospective market as a demand for fructose, particularly as sweetener of refreshing beverage has recently increased. However, solidification of fructose-containing liquid sugar having its FE lower than 100 is more difficult than that of pure liquid fructose and a more effective method of solidification has been demanded. Fructose-containing liquid sugar of FE lower than 100, for example, of FE 90 is necessarily a multi-ingredient system which is difficult to be crystallized. When usual process of crystallization in non-aqueous solvent is employed, such multi-ingredient system would produce crystalline and amorphous solids in the form of the finest particles and increase its viscosity due to mixing with molasses, resulting in that a desired solid/liquid separation becomes extremely difficult or impossible. Accordingly, this process is most disadvantageous in that a relatively simple filtration treatment using a filter can not be employed here. The technical interest has been concentrated into a process for preparation of fructose-containing solid sugar from fructose-containing liquid sugar, particularly liquid sugar having its FE in the order of 90, which has a high value added, or liquid sugar of FE in the order of 40 which can be obtained at a lower cost. A principal object of the present invention is to provide such process.

SUMMARY OF THE INVENTION

The present invention provides a process for preparation of fructose-containing solid sugar comprising a step of dehydration at which fructose-containing liquid sugar is brought, at the presence of an organic solvent exhibiting azeotropic behavior with respect to water, in contact with a stream of gas causing no denaturation of fructose-containing sugar to remove moisture contained therein, a step of aging at which the fructose-containing liquid sugar obtained from said step of dehydration is subjected to seed crystal addition treatment and a step of solidification at which the aged fructose-containing sugar obtained from said step of aging is introduced into anhydrous alcohol.

By processing through the above-mentioned three steps it is possible to produce a sufficiently hard fructose-containing solid sugar from the fructose-containing liquid sugar in a wide range of FE value.

DETAILED DESCRIPTION

The step of dehydration is substantially for previous dehydration of fructose-containing liquid sugar so that preferred aged fructose-containing sugar and fructose-containing solid sugar are obtained at the step of aging and the step of solidification following said step of dehydration, respectively. Although no special limitation is imposed to a moisture content of fructose-containing liquid sugar as raw material, it is preferred that the liquid sugar has previously been concentrated to the moisture content (e.g., 20 to 30% by weight) which can be easily attained by the usual process. Fructose-containing liquid sugar (of FE 40 or higher) is supplied from a top of a dehydration device and brought in contact with a stream of gas preferably in the relationship of counter current. The dehydration device may be of any types so far as they enable efficient gas-liquid contact. Said gas-liquid contact is effected at the presence of organic solvent exhibiting azeotropic behavior with respect to water in accordance with the present invention and this organic solvent may be introduced into the dehydration device after mixed with and dissolved in fructose-containing liquid sugar or entrained with the stream of gas for introduction or these two methods may be combined. Alcohol is preferred as said organic solvent and ethanol is most preferable in view of a fact that the process for food preparation is concerned. In addition to alcohol, other solvent such as benzene and toluene may be used together to improve azeotropic effect. Recovery efficiency of these solvents must be sufficiently high that substantially no trace of benzene or toluene remains in the final product. As the stream of gas, a stream of nitrogen is preferred. Flow rate of gas or organic solvent-gas mixture is preferably 200 to 5000 in the hourly space velocity (SV). It is difficult to obtain an effective dehydration at a flow rate lower than SV 200 while no remarkable improvement of dehydrating effect can be expected even at a flow rate of SV 5000 or higher. For efficient dehydration and prevention of fructose denaturation, it is preferred to maintain the dehydration temperature at a temperature range between the azeotropic point of used organic solvent with water and a temperature 10° C. higher than this azeotropic point. In the case in which ethanol is used as the organic solvent, the dehydration temperature is maintained at a range between 78° C. and 88° C., since the azeotropic point of ethanol with respect to water lies at approximately 78° C. No limitation is imposed to the manner of heat supplying so far as said temperature can be maintained. The stream of gas has various advantageous effects such as reducing a partial pressure in the gaseous phase of vaporized ingredients, giving an agitating force for fructose-containing liquid sugar and serving as a medium to supply the heat of vaporization when the stream of gas has previously heated. These effects cooperate with the azeotropic effect of the organic solvent to achieve dehydration by vaporization. It is also possible to carry out said operation of dehydration in two steps using a vessel having a primary chamber and a secondary chamber. With such arrangement, fructose-containing liquid is brought in contact only with the stream of gas in the primary chamber and brought in contact with the stream of gas at the presence of organic solvent in the secondary chamber to improve the use efficiency of the organic solvent. Most of the organic solvent is entrained with the stream of gas and discharged together with moisture, but the organic solvent can be repeatedly used after a moisture has been removed therefrom. A part of the organic solvent is uniformly mixed with the dehydrated fructose-containing liquid sugar and discharged therewith. A concentration of the organic solvent at which the latter is mixed with said dehydrated fructose-containing liquid sugar varies depending upon the quantity of organic solvent used at said step of dehydration and the mutual action between this organic solvent and the stream of gas. To achieve a preferred aging effect and to obtain preferred fructose-containing solid sugar at the step of solidification, the quantity of organic solvent to be used is controlled so that 1 to 20% by weight of organic solvent is mixed into the dehydrated fructose-containing liquid sugar. The above mentioned fact that organic solvent is uniformly mixed into the liquid sugar obtained at said step of dehydration provides an important advantage according to the present invention. Specifically, the moisture content of fructose-containing liquid sugar is preferably reduced to a level lower than 30% by weight (except organic solvent) at the step of dehydration to obtain a preferable fructose-containing solid sugar at the step of solidification, but the fructose-containing liqud sugar thus dehydrated to the moisture content lower 3% by weight has usually exhibited so high viscosity that the seed crystal addition treatment for separation by crystallization is difficult and the pumping transport essential to the industrial process for preparation is almost impossible. Accordingly, it is necessary to add a suitable non-aqueous solvent to such dehydrated and concentrated fructose-containing liquid sugar of high viscosity to reduce the viscosity and thereby to separate crystal therefrom. However, a considerable agitating force and a much time have usually been necessary to add a sufficient quantity (1 to 20% by weight) of non-aqueous solvent to the solid sugar once concentrated to a high viscosity to achieve a desired separation by crystallization. According to said step of the present invention, it is possible to control the process so that a proper quantity of organic solvent is homogeneously mixed into the liquid sugar concentrated as mentioned above, thus making it possible to introduce the obtained concentrated liquid sugar into the step of aging for seed crystal addition treatment while said concentrated liquid sugar is kept heated.

At the step of aging, the fructose-containing liquid sugar having the organic solvent content of 1 to 20% by weight and the moisture content lower than 3% by weight which has been obtained at the step of dehydration is aged through the seed crystal addition treatment, using crystalline fructose or mixed crystal of fructose and glucose (a mixing ratio of fructose and glucose is variable). In an aging vessel of agitation type, it is preferred to adjust a quantity of seed crystal so that 1 to 10 hours are taken to achieve desired aging effect. Not only said mixed crystal but also a part of the fructose-containing solid sugar which is obtained at the step of solidification can be used as the seed crystal. It is obvious that the aging vessel may be a single vessel or a plurality of such vessels arranged in series or parallel, so far as a desired time of aging is thereby obtained. When the step of aging is carried out in a plurality of vessels, a quantity of seed crystal may be supplemented depending upon aging degrees in the respective vessels to improve the aging efficiency. Properties of the fructose-containing sugar obtained at the step of aging depend upon FE value thereof and, when the FE value is less than 90, the sugar takes a form of white crystalline aggregate having gloss like starch jelly or water glass. Even if organic solvent remaining therein is removed, the product thus obtained can not be directly used as the fructose-containing solid sugar because of its behaviour of deliquescence. This behaviour of deliquescence is due to the hydrophilic amorphous substance generally referred to as molasses and prevents formation of the desired fructose-containing solid sugar even after removal of organic solvent, since the product immediately becomes viscous due to said deliquescence. Said molasses or syrup apparently consist of remarkably hydrophilic ingredients and can be easily eliminated at the step of solidification as will be described below. One of features of the present invention certainly lies in that the present invention is applicable for fructose-containing sugar covered by a wide range of FE value between FE 40 and FE 100. However, lower the FE value of fructose-containing sugar, stronger the tendency of said viscosity increase is, and thus properties of fructose-containing solid sugar obtained at the step of solidification are variable depending upon the initial FE value. Namely, the product solidified from fructose-containing sugar of relatively low FE value is slightly softer than the product solidified from fructose-containing sugar of relatively high FE value and encounters and inconvenience for molding when the perforated plate extrusion method or like is used to obtain acceptable fructose-containing solid sugar at the step of solidification. With respect to the above-mentioned drawback, the inventor has found that it can be eliminated by reducing oligosaccharide contained in the fructose-containing liquid sugar to be subjected to contact with the gas stream to 2% by weight, preferably to 1% by weight. Generally the oligosaccharide refers to disaccharide—hexasaccharide formed by glycosido bonding of two or more monosaccharide through dehydration. It is found that reduction of oligosaccharide makes it possible to shorten the aging time to half, and even the fructose-containing liquid sugar of a low FE value can be turned into the solid sugar of sufficient hardness by solidification process. Also this facilitates molding, drying and pulveration to obtain acceptable fructose-containing solid sugar. For reducing oligosaccharide contained in the fructose-containing liquid sugar, a known method may be used, for example, decomposing oligosaccharide by Pullulanase.

At the step of solidification, said aged fructose-containing sugar is introduced into anhydrous alcohol for solidification. The term "anhydrous alcohol" used here never means the perfectly water-free alcohol but the alcohol which can dehydrate the fructose-containing solid sugar to a moisure content lower than 0.5% by weight. As such alcohol, ethanol is preferred. Furthermore, it is preferable for the process to use the alcohol identical to the compound used as organic solvent at the step of dehydration. When the aged fructose-containing sugar is introduced into anhydrous alcohol, molasses mixed therein elutes and, as a result, said gloss of water glass is lost and simply dim white solid is left. After already subjected to the steps of dehydration and aging, the step of solidification following these steps needs not to include a dispersion process for pulveration of solid sugar by means of agitation or like to improve the efficiency of solid-liquid contact. Accordingly, the aged fructose-containing sugar is solidified in the form with which it has been introduced into anhydrous alcohol, namely, when said sugar is introduced by extrusion through the perforated plate into anhydrous alcohol in the form of sticks, said sugar is solidified in the form of these sticks and thereby the desired solid-liquid separation is extremely facilitated. Obviously it is possible to obtain fructose-containing solid sugar of various particle sizes and various forms by using the other manners of introduction such as spraying, rolling and droplet spreading.

The process according to the present invention by which preferred fructose-containing solid sugar is obtained is essentially distinguished from the usually used processes relying upon crystallization and recrystallization, respectively, at the presence of alcoholic solvent. Three steps of dehydration, aging and solidification in the process according to the present invention are in inseparable relationship with one another and organic combination of these steps enables solidification of fructose-containing liquid sugar of relatively low FE which has conventionally been considered impossible. Without being subjected to these three steps, for example, when fructose-containing liquid sugar is directly introduced into anhydrous alcohol for simultaneous dehydration, aging and solidification, finely divided solid is produced and this is inconvenient for the desired solid-liquid separation. By the process according to the present invention, on the contrary, a massive solid convenient for said solid-liquid separation is obtained. Further advantage of the present invention lies in that fructose-containing solid sugar of a preferred form can be obtained by regulating factors such as a degree of aging and a moisture content of the aged fructose-containing sugar to be introduced into the step of solidification and by changing the manner in which such introduction occurs. Furthermore, the process according to the present invention provides fructose-containing solid sugar with a high yield. This is due to the manner of dehydration peculiar to present invention. More specifically, fructose-containing sugar is more readily soluble in alcohol of a higher moisture content, but the fructose-containing liquid sugar has been sufficiently dehydrated at the step of dehydration, so that it is possible to suppress a quantity of the sugar dissolved in anhydrous alcohol at the final step of solidification even when the sugar is introduced into said anhydrous alcohol. When said anhydrous alcohol in which a minute quantity of sugar is present at this step of solidification is recycled to the step of dehydration as previously mentioned, the yield with which fructose-containing solid sugar is obtained can be substantially improved. Without such recycling of alcohol, it is possible to achieve the yield of fructose-containing solid sugar of 90% or higher. In the process according to the present invention, it is possible to establish a complete closed system so far as the solvents are concerned. This results in an extremely high recovery rate of solvent. The recovery rate of solvents from the step of dehydration is substantially 100% and the quantity of alcohol used at the step of solidification can be used as the organic solvent for the step of dehydration. The organic solvent used at the step of dehydration serves not only to help dehydration through vaporization under its azeotropic effect but also to reduce the viscosity of dehydrated fructose-containing liquid sugar and thereby to improve the aging effect at the step of aging. The organic solvent is thus advantageous from the viewpoint of process engineering.

According to the present invention, as seen from the foregoing description, the solvent recovery rate can be substantially improved by establishing a completely closed system and the process can be adapted for a wide range of FE by adjustment of operating conditions of the respective steps, permitting the stable fructose-containing solid sugar of high quality to be prepared at a low cost.

The present invention will be now described more in detail with respect to several embodiments, but is should be realized here that the present invention is not limited to these embodiments.

EXAMPLE 1

Solidification of fructose-containing liquid sugar of FE 42

Fructose-containing liquid sugar of FE 42 and a moisture content of 15% by weight, of which the solute composition comprised fructose of 42% by weight, glucose of 52% by weight and other oligosaccharide of 6% by weight, was added with 99.5% ethanol weighing 2.4 times said liquid sugar and the latter was dissolved in said ethanol under heating to prepare a sample. A packed column of double-cylinder structure through which a stream of hot water at 80° C. to 85° C. was circulated to heat this packed column was supplied through the column bottom with a stream of nitrogen gas heated at a temperature of 85° C. and flowing at a space velocity of SV 3000 while said sample was introduced through the column top into the packed column at LHSV (liquid hourly space velocity) 0.5. The packed column discharged through the column bottom a quantity of dehydrated fructose-containing liquid sugar with a moisture content of 0.4% by weight and an ethanol content of 3.4% by weight. The stream of nitrogen gas discharged through the column together with a quantity of water and a quantity of ethanol entrained thereby was cooled by water and suitable refrigerant at a temperature of −10° C. to −20° C. before recovery thereof. Condensate thus obtained was aqueous ethanol concentrated at 94.1% by weight and a recovery rate of such ethanol was 98.5%. 200 g of fructose-containing liquid sugar thus obtained was transferred to an aging vessel. 20 g of crystalline fructose and 20 g of anhydrous crystalline glucose were added as seed crystal and aged at a temperature of 65° C. by agitation. The aged fructose-containing sugar initially exhibited white water glass appearance and progressively changed into white crystalline aggregate. This aggregate was extruded through a slit arranged within a mass of anhydrous ethanol and fructose-containing sugar in the form of flat flake was obtained. After removal of ethanol, 178 g of dried sugar was obtained. Sugar dissolved in ethanol exhibited FE value of 40 and 62 g thereof (in dried condition) was recovered.

EXAMPLE 2

Effect of reduced oligosaccharide in the liquid sugar

Experiment was carried out with the same condition as that of Example 1 except with solute composition comprising fructose of 42% by weight, glucose of 57.4% by weight, and oligosaccharide of 0.6% by weight. The fructose-containing sugar discharged from the lower end of the dehydrator was turned into a white crystalline aggregate in about a half of the aging time required in Example 1, and the solid sugar obtained after extruding said aggregate through the slit into the anhydrous ethanol was considerably harder than the sugar obtained in Example 1.

EXAMPLE 3

Solidification of fructose-containing liquid sugar of FE 90

Fructose-containing liquid sugar of FE 90 and a moisture content of 15% by weight, of which the solute composition comprised fructose of 90% by weight, glucose of 9% by weight and other oligosaccharide of 1% by weight, was added with 99.5% ethanol weighing 2.4 times said liquid sugar and the latter was dissolved in said ethanol under heating to prepare a sample. The sample was brought in contact with a heated stream of nitrogen gas in the same manner as in Example 1. Dehydrated fructose-containing liquid sugar thus obtained exhibited a moisture content of 0.3% by weight and an ethanol content of 3.0% by weight. 200 g of this fructose-containing liquid sugar was transferred to the aging vessel and added with 20 g of crystalline fructose as seed crystal. The mixture was aged at a temperature of 65° C. by agitation for 4 hours, the aged fructose-containing sugar initially exhibited white water glass appearance and progressively changed into white crystalline aggregate, while the agitation was heavily loaded. This aggregate was extruded through the perforated plate into a solidifying vessel containing therein anhydrous ethanol and fructose-containing sugar in the form of pellets. After removal of ethanol, 186 g of dried sugar was obtained and sugar dissolved in ethanol exhibited FE value of 82 and 20 g (in dried condition) thereto was recovered.

EXAMPLE 4

Water solubility of fructose-containing solid sugar

Solution velocity with respect to water was measured at a normal temperature for fructose-containing solid sugar of FE 90 and molded as pellets each having a diameter of 2 mm and a length of 5 mm which was obtained in Example 3 in comparison with commercially available crystalline pure fructose. Said fructose-containing solid sugar of FE 90 exhibited a solution velocity 10 to 20% higher than said crystalline pure fructose.

EXAMPLE 5

Moisture absorption characteristic of fructose-containing solid sugar

Moisture absorption velocity at a humidity of 60% was measured at a normal temperature for fructose-containing solid sugar of FE 90 and molded as pellets each having a diameter of 2 mm and a length of 5 mm which was obtained in Example 3 in comparison with commercially available crystalline pure fructose. Said fructose-containing solid sugar of FE 90 exhibited an increase of weight 5 to 10% less than that exhibited by said crystalline pure fructose. Namely, it was found that the former is preferred to the latter as commodities, so far as the humidity is concerned.

What is claimed is:

1. A process for preparation of fructose containing solid sugar, said process comprising:

a step of dehydration in which fructose containing liquid sugar of FE of less than 100 is brought, while in the presence of an organic solvent exhibiting azeotropic behaviour with respect to water, in contact with a stream of gas causing no denaturation of fructose containing sugar, with heating during the dehydration step to remove water in a vapor phase together with said organic solvent thereby to reduce the water content to less than 3% by weight with respect to said fructose-containing sugar (excluding the residual organic solvent);

a step of aging in which the fructose containing liquid sugar obtained from said step of dehydration is subjected to seed crystal addition treatment in 1 to 20% by weight of organic solvent and the aging is carried out until an aged, somewhat deliquescent crystalline aggregate is formed from the sugar;

a step of solidification in which the aged fructose containing sugar obtained from said step of aging is introduced into anhydrous alcohol and kept therein until any molasses mixed in the sugar is eluted and the sugar is solidified as a non-deliquescent sugar; and a step of removing the alcohol from the solid non-deliquescent sugar obtained from said step of solidification.

2. A process for preparation of fructose-containing solid sugar according to claim 1, wherein, during the step of dehydration, the temperature is maintained within a range from a temperature corresponding to the azeotropic point of said organic solvent and water to a temperature 10° C. higher than this azeotropic point.

3. A process for preparation of fructose-containing solid sugar according to claim 1 or 2, wherein said stream of gas utilized in the step of dehydration flows at an hourly space velocity of 200 to 5000.

4. A process for preparation of fructose-containing solid sugar according to claim 1 or 2, wherein the step of dehydration comprises a primary dehydration in which the fructose-containing liquid sugar is merely brought in contact with said stream of gas and a secondary dehydration in which the fructose-containing liquid sugar is brought in contact with said stream of gas in the presence of said organic solvent.

5. A process for preparation of fructose-containing solid sugar according to claim 1 or 2, wherein, as said stream of gas, a stream of nitrogen gas is used in the step of dehydration.

6. A process for preparation of fructose-containing solid sugar according to claim 1 or 2, wherein the fructose-containing liquid sugar subjected to the step of dehydration has a Fructose Equivalent (FE) of 40 or higher.

7. A process for preparation of fructose-containing solid sugar according to claim 1 or 2 wherein the fructose-containing liquid sugar obtained from the step of dehydration contains 1 to 20% by weight of said organic solvent and said liquid sugar is subjected to the step of aging without any further addition of said organic solvent.

8. A process for preparation of fructose-containing solid sugar according to claim 1 or 2, wherein said organic solvent is alcohol used as solvent.

9. A process for preparation of fructose-containing solid sugar according to claim 8, wherein said alcohol is the same compound as anhydrous alcohol used in the step of solidification.

10. A process for preparation of fructose-containing solid sugar according to claim 8, wherein said alcohol is ethanol.

11. A process for preparation of fructose-containing solid sugar according to claim 1 or 2, wherein the solid fructose-containing sugar is partially recycled to the step of aging and thereby said fructose-containing liquid sugar is subjected to the seed crystal addition treatment.

12. A process for preparation of fructose-containing solid sugar according to claim 1 or 2, wherein the anhydrous alcohol used in the step of solidification is anhydrous ethanol.

13. A process for preparation of fructose-containing solid sugar according to claim 1 or 2, wherein the fructose-containing liquid sugar to be subjected to contact with said gas stream in dehydration step contains less than 2% by weight of oligosaccharide.

14. A process for preparation of fructose-containing solid sugar according to claim 1 or 2, wherein said fructose containing liquid sugar has an FE in the range of from about 40 to about 90.

15. A process for preparation of fructose-containing solid sugar according to claim 1 or 2, wherein the recovery rate of solvent from the step of dehydration is substantially 100 percent.

* * * * *